US007412185B2

(12) United States Patent
Hall et al.

(10) Patent No.: US 7,412,185 B2
(45) Date of Patent: Aug. 12, 2008

(54) CONTROLLING AVERAGE POWER TO A FUSER

(75) Inventors: Jeffrey Hall, Meridian, ID (US); Michael Martin, Boise, ID (US); Bartley Mark Hirst, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 210 days.

(21) Appl. No.: 11/060,452

(22) Filed: Feb. 16, 2005

(65) Prior Publication Data

US 2006/0182458 A1 Aug. 17, 2006

(51) Int. Cl.
*G03G 15/00* (2006.01)
*G03G 15/20* (2006.01)

(52) U.S. Cl. ..... 399/88; 399/37; 399/67

(58) Field of Classification Search ..... 399/37, 399/67, 69, 70, 68, 88, 486; 219/486
See application file for complete search history.

(56) References Cited

U.S. PATENT DOCUMENTS 5,349,905 A 9/1994 Taylor et al.
5,483,149 A 1/1996 Barrett
5,550,637 A 8/1996 Murakami
5,699,239 A 12/1997 Komori
5,978,285 A 11/1999 Ingalls
6,072,585 A 6/2000 Dutton et al.
6,178,299 B1 1/2001 Kim
6,198,643 B1 3/2001 Gray
6,243,626 B1 6/2001 Schanin
6,246,842 B1 6/2001 McClure
6,459,175 B1 10/2002 Potega
6,465,987 B1 10/2002 Haas et al.
6,496,665 B2 12/2002 Umezawa et al.
6,591,073 B1 7/2003 Fujii
6,748,184 B2 * 6/2004 Umezawa et al. ..... 399/67
2002/0140964 A1 10/2002 Goto et al.
2002/0188876 A1 12/2002 Forbes et al.
2003/0085621 A1 5/2003 Potega
2003/0202813 A1 10/2003 Schoedinger
2004/0003299 A1 1/2004 Malueg et al.
2004/0003300 A1 1/2004 Malueg et al.
2004/0028422 A1 2/2004 Umezawa et al.

OTHER PUBLICATIONS

U.S. Appl. No. 10/832,089, filed Apr. 26, 2004, Elgee et al.

* cited by examiner

*Primary Examiner*—Hoang Ngo

(57) ABSTRACT

Disclosed are embodiments for controlling one or more subsystems of an imaging system to manage average power to a fuser.

78 Claims, 5 Drawing Sheets

CONTROLLING AVERAGE POWER TO A FUSER

RELATED APPLICATIONS

The subject matter disclosed herein relates to U.S. patent application Ser. No. 10/832,089 filed on Apr. 26, 2004, titled "Air Heating Apparatus" and assigned to the assignee of claimed subject matter.

BACKGROUND

Among the types of office equipment that consume power, printers have dynamic power use that may depend on a state of the printer (e.g., standby, warm up, scanning and printing). In a laser printer in particular, a fuser typically consumes substantial power from time to time during intervals to maintain fuser temperatures for proper image fusing. These intervals of substantial power consumption may result in the use of more costly power infrastructure installations than would otherwise be used.

BRIEF DESCRIPTION OF THE FIGURES

Non-limiting and non-exhaustive embodiments will be described with reference to the following figures, wherein like reference numerals refer to like parts throughout the various figures unless otherwise specified.

DETAILED DESCRIPTION

Figure 2A:
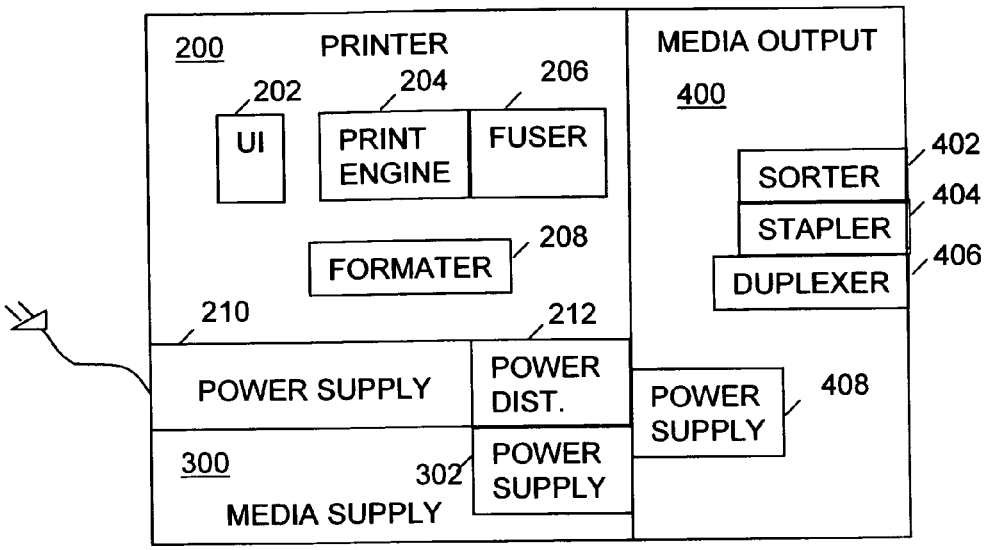
FIG. 2A is a schematic diagram of an embodiment of a printer.

Reference throughout this specification to "one embodiment" or "an embodiment" means that a particular feature, structure, or characteristic described in connection with the embodiment is included in at least one embodiment of claimed subject matter. Thus, the appearances of the phrase "in one embodiment" or "an embodiment" in various places throughout this specification may not all be referring to the same embodiment. Furthermore, the particular features, structures, or characteristics may be combined in one or more embodiments.

"Imaging media" as referred to herein relates to a substrate that is capable of expressing a visual image. For example, imaging media may comprise one or more surfaces for receiving a printed image based, at least in part, upon image data. Such imaging media may comprise paper (including envelopes), labels, cardboard, film, transparencies, painted surfaces, canvass, cloth. However, these are merely examples of imaging media and claimed subject matter is not limited in these respects.

"Image data" may comprise information representative of at least a portion of a visual image. In a particular embodiment, for example, image data may comprise digital data representing one or more visual aspects of an image. Such digital data may comprise data which is arranged according to a particular format and/or coding scheme, such as a bit mapped format or other types of formats, from which visual images may be constructed, communicated and/or transferred to imaging media. However, these are merely examples of image data and claimed subject matter is not limited in this respect.

An "imaging device" as referred to herein relates to a device or apparatus that is capable of transferring an image to a media based, at least in part, upon image data. Such an imaging device may employ any one of several types of image transfer technologies such as, for example, ink jet printing, direct thermal printing, laser printing and/or dye diffusion printing. However, these are merely examples of technologies that may be employed by an imaging device to transfer an image to imaging media and claimed subject matter is not limited in these respects. Imaging devices may be employed in any one of several apparatuses that perform, among other things, transferring an image to imaging media such as, for example, office, industrial printing, copy machines, facsimile machines, medical imaging equipment and the like. However, these are merely examples of how an imaging device may be employed in an apparatus and claimed subject matter is not limited in these respects.

"Instructions" as referred to herein relate to expressions which represent one or more logical operations. For example, instructions may be "machine-readable" by being interpretable by a machine for executing one or more operations on one or more data objects. However, this is merely an example of instructions and claimed subject matter is not limited in this respect. In another example, instructions as referred to herein may relate to encoded commands which are executable by a processing circuit having a command set which comprises the encoded commands. Such an instruction may be encoded in the form of a machine language understood by the processing circuit. Again, these are merely examples of an instruction and claimed subject matter is not limited in this respect.

"Storage medium" as referred to herein relates to a medium capable of maintaining expressions which are perceivable through use of one or more machines. For example, a storage medium may comprise one or more storage devices for storing machine-readable instructions. Such storage devices may comprise any one of several data storage media types including, for example, magnetic, optical or semiconductor storage media. However, these are merely examples of a storage medium and claimed subject matter is not limited in these respects.

"Current" as referred to herein relates to a rate at which an electrical charge passes through an electrical conductor. A magnitude of a current may be quantified in standard units such as Amperes. "Power" as referred to herein relates to a rate at which energy is transferred, consumed and/or generated by a device or collection of devices. Power may be quantified in standard units such as Watts. Power may be transmitted to an electronic device or collection of devices from electrical energy in one or more "power signals" as a direct current and/or alternating current provided at the power input terminals. The electronic device or devices may be characterized as having a power load. In this regard, the power consumed by such an electronic device or collection of devices may be quantified in terms of the power load and/or the current of the power signal(s) being supplied to the electronic device or collection of electronic devices. Also, with predetermined voltage characteristics of a power signal (e.g., a set DC voltage of a DC power signal and/or set amplitude voltage of an AC power signal), the power consumed by one or more electronic devices may be quantified based, at least in part, upon the current being drawn by these devices. However, this is merely an example of how power consumed by devices may be quantified and claimed subject matter is not limited in this respect.

A "level of power" may be characterized by an amount of power being drawn by one or more devices over a short duration (e.g., fraction of a second) or over a longer period such as five to ten seconds. For an AC power signal, for example, a level of power may be quantified in units of root mean squared power (e.g., watts RMS). Also, a level of power may be characterized as an average power drawn over a set duration. However, these are merely examples of a level of power and claimed subject matter is not limited in these respects.

A "power supply" as referred to herein relates to a device to provide power to an electronic device or collection of electronic devices according to one or more power usage profiles. For example, a power supply may provide a current to an electronic device or collection of devices having a power load. A power supply may be coupled to a "power source" that generates or transmits electrical energy in a particular form. Such a power source may be coupled to the power supply by a utility outlet in a building. However, this is merely an example of a power source and claimed subject matter is not limited in these respects. A power supply may provide a converted power signal to the electronic device or collection of devices in response to electrical energy provided by the power source.

Electronic equipment is typically constructed of a plurality of "subsystems." Subsystem in such electronic equipment may contribute to a portion of a power load of the electronic equipment drawing power from a power source. Accordingly, the power supplied to the electronic equipment may comprise at least the sum of the power supplied to the subsystems making up the electronic equipment.

A "process speed" as referred to herein relates to a rate at which images may be transferred to imaging media using a particular image transfer technique. In laser printing, for example, a process speed may be determined, at least in part, by capabilities of an imaging device in transferring an image to media, a motor and/or feeder speeds, etc. In one particular embodiment, for example, a process speed of a laser printer may be based, at least in part, on a particular electro-photographic process of a laser printer However, this is merely an example of how a process speed may be characterized and claimed subject matter is not limited in this respect.

An "inter-page gap" and "inter-document gap," used interchangeably herein, relates to a pause in between printing successive media sheets (e.g., pages) in a printer. For example, an inter-page gap may represent the time between the ending of printing in a first page and the beginning of printing in a second page. However, this merely an example of how an inter-page gap or inter-document gap may be quantified and claimed subject matter is not limited in this respect.

A printer "throughput" as used herein relates to the rate at which pages or documents may be transferred to sheets of imaging media. In one particular embodiment, for example, a printer throughput may be quantified as pages per minute. In another particular embodiment, a printer throughput may be based, at least in part, on a particular process speed and/or inter-page gap. However, these are merely examples of a printer throughput and claimed subject matter is not limited in these respects.

In one example, a process speed for a printer may affect a printer throughput quantified in units such as pages per minute. Here, a process speed may be characterized as a rate at which an image is transferred to media.

Briefly, an embodiment relates to a system and/or method of providing power to an apparatus comprising one or more subsystems including an imaging device for transferring an image to imaging media. The apparatus may be configured in response to an amount of power being drawn by the subsystems. However, this is merely an example embodiment and claimed subject matter is not limited in this respect.

Figure 1:
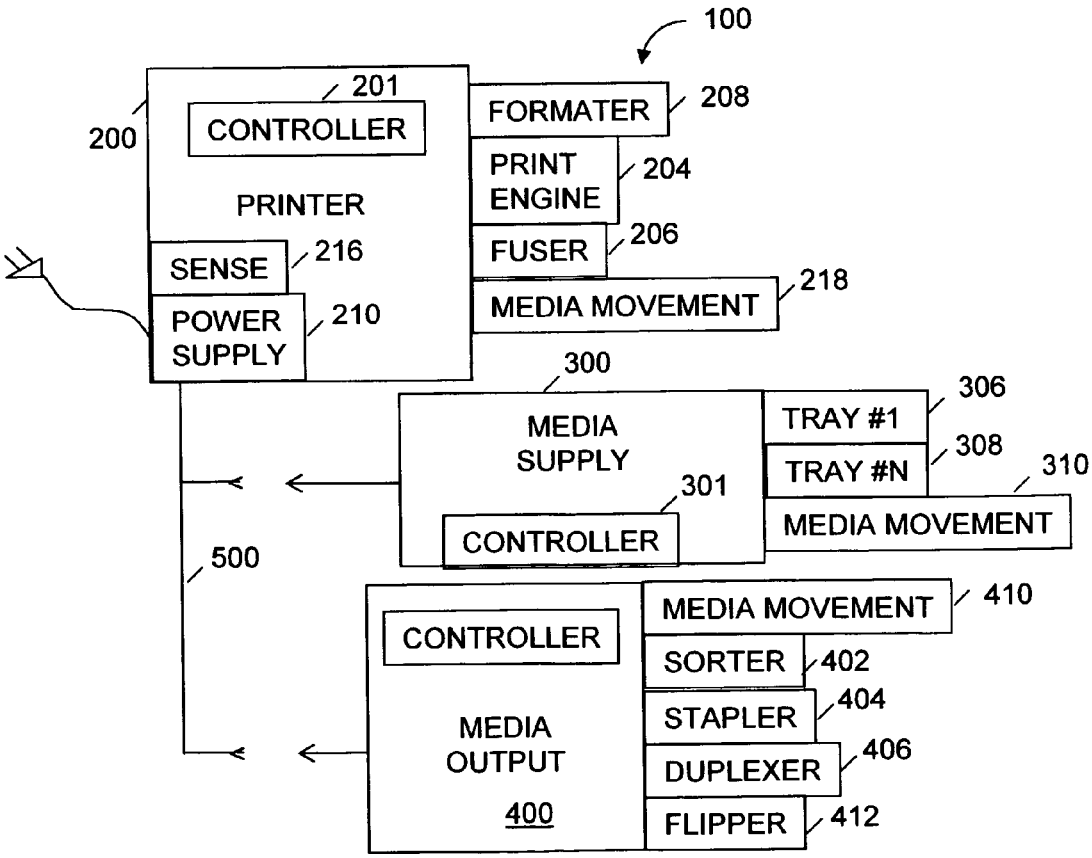
FIG. 1 is a schematic diagram of an embodiment of an imaging system.

FIG. 1 shows a schematic block diagram of an imaging system 100 according to an embodiment. Imaging system 100 may be employed in any one of several environments and image transfer applications such as, for example, office printing and/or copying, industrial printing and/or medical imaging. However, these are merely specific examples of how an imaging system may be used and claimed subject matter is not limited in these respects. The terms "imaging system" and "printing system" are used interchangeably herein. Such an imaging system or printing system may comprise any one of several apparatuses comprising an imaging device to transfer an image to imaging media.

The terms "configuration" and "operating mode" are referred to interchangeably herein and relate to an operational state of an imaging system. Such a configuration and/or operating mode may be selectable or controlled by a user and/or automatically by a controller. A configuration and/or operating mode of an imaging system may be determined by a state of one or more subsystems of the imaging system. However, these are merely examples of a configuration and/or operating mode and claimed subject matter is not limited in these respects.

The imaging system 100 is shown with printer 200, an optional media supply unit 300 and an optional media output unit 400. These particular options are merely provided as examples to aid the reader in understanding the disclosed subject matter and claimed subject matter is not limited in these respects. The imaging system 100 comprises several subsystems such as, for example, a power supply 210, formatter 208, print engine 204 and fuser 206. Media movement 218 may represent motors, gears, and/or diverters that result in the media moving through the printer 200. A sense circuit 216 may sense an input power signal and may also sense the number and/or type of accessories attached to printer 200.

A bus 500 connects accessories to the printer 200. In one embodiment, the bus 500 comprises power and communication channels, however, claimed subject matter is not limited to such an arrangement. The bus 500 may pass power while data communication is handled through a second I/O channel such as an infrared (IR) channel. Alternatively, the bus 500 may comprise data communications through any number of I/O formats (IR, RF, wires, magnetic coupling, etc.). Power for accessories may come from a source other than the power supply 210 (e.g., directly from a wall outlet). Independent of the structure of bus 500, a sense circuit 216 may monitor the input power signal and relay information characterizing the input power signal to a printer controller 201. The printer controller 201 may then use this information characterizing the input power signal to determine a configuration and/or operating mode for the imaging system 100.

The media supply accessory 300 comprises a controller 301 for communicating with printer 200 and managing proper operation of the media supply 300. Media supply 300 comprises multiple media trays 306-308. A media tray may be designed for high capacity and/or different types or sizes of sheets of imaging media. Media movement 310, as in printer 200, may represent motors, gears, and/or diverters that result in the media moving through the media supply accessory.

The external media output accessory 400 comprises a controller 401 for communicating with printer 200 and managing proper operation of the media output 400. Media output 400 may comprise several operations such as a sorter 402, stapler 404 and/or media movement 410. Duplexer 406 may be part of the media output accessory, or it may be a separate accessory that attaches directly to the printer 200. Flipper 412 may be used to change the orientation of the paper thereby allowing the media output to output either face-up or face-down.

FIG. 2A shows a schematic diagram of an embodiment of the printer 200 shown in the imaging system of FIG. 1. The printer 200 may comprise a plurality of subsystems that may draw electrical power for operation, including, for example, a user interface (UI) 202 (which may comprise an input device such as a keypad and/or a output device such as a display), a print engine 204 (to control the physical transfer of images to imaging media), a formatter circuit assembly 208 (which may convert the data received into a format that the print engine 204 uses to create an image on the imaging media) and a fuser 206 (which uses high temperature and pressure to fuse the image onto the imaging media). However, it should be understood that these are merely examples of subsystems in an imaging system that may draw power for operation and that claimed subject matter is not limited in these respects. A power supply 210 converts an input power signal from an electrical outlet into operating voltages for operating the other subsystems of the printer 100. The power supply 210 may be designed such that it can accept a variety of input voltages of a power source. Power distribution 212 is responsible for distributing both power and power information among the subsystems.

While the embodiment shown in FIG. 1 is particularly directed to a laser printer type of imaging device, claimed subject matter may be applied to other types of imaging systems using other types of image transfer techniques such as, for example, other types of direct thermal imaging, ink jet imaging and/or dye diffusion imaging. It should be understood that while such imaging systems using other types of image transfer techniques may comprise subsystems which are different from those of a laser printer, claimed subject matter may also apply to these imaging systems.

While not shown in FIG. 1, the imaging system 100, according to a particular embodiment, may comprise a scanner subsystem that is capable of capturing images from a scanned surface to be stored and/or reproduced on imaging media provided by the media supply 300. Such a scanner subsystem may generate image data according to a particular format representing the captured image. By including a scanner, for example, the imaging system may comprise functionality as a copier (e.g., by printing the captured image based, at least in part, on the image data), facsimile machine (e.g., by transmitting the image data over phone lines) or a multifunction printer (MFP). Such an MFP may also comprise an automatic document feeder (ADF) to sequentially feed pages of a document to the scanner for image capture. Here, the scanner and ADF may scan documents at a first rate (e.g., 60 pages per minute) for the printer 200 operating a slower throughput (e.g., 40 pages per minute). The stapler 404 and sorter 402 may be set to staple and stack every two pages. In this situation, peak power load (and peak current draw) may occur when the scanner head is reversing direction at the same time the ADF is picking the next page and ejecting the current page, the print engine 204 is picking a page, and the media output unit 400 is stapling. This peak power condition may last over 100 ms.

The power supply 210 may receive a power signal from a power source such as a single 15 amp, 110-120 VAC outlet in the United States capable of delivering about 1650 watts. However, this is merely an example of the characteristics of a power signal that may be provided from a power source to an imaging system and claimed subject matter may also be applicable to imaging systems that receive a power signal with different characteristics. In the presently illustrated embodiment, assuming printer 200 uses about 1500 watts during full speed printing, the addition of accessories, such as media supply 300 and/or media output 400, may result in power consumption exceeding available power. To operate within a set power budget, a configuration and/or operating mode of the imaging system 100 may be controlled so that one or more of its individual subsystems employs less power without significantly degrading performance of imaging system 100.

Among other things, the printer controller 201 performs several control duties such as, for example, diagnostics, processing input from and providing display information to the UI 202, managing power supplied to the subsystems of the imaging system 100, maintaining maintenance logs, controlling the process speed and/or inter-page gap (thereby affecting throughput), tracking the status of consumables (e.g., toner cartridges), controlling and/or monitoring sensor input signals and/or solenoid output signals and controlling changes in DC power signals. Regarding controlling the printer throughput, in a particular embodiment, the printer controller 201 may alter a process speed and an inter-page gap depending, at least in part, on the type of image being printed (e.g., flat versus glossy) or the type of media used (e.g., paper, labels or card stock, etc). In a particular example, a process speed may be reduced from full speed to half speed to allow an increase in a gloss quality of a resulting image, or further reduced to a quarter speed if the glossy image is to be printed on heavy media. Further, when printing on particularly heavy media, the printer controller 201 may increase the inter-page gap to allow a fusing system (e.g., fuser 206) to recover from heavy thermal loads. However, these are merely examples of how a printer controller may be employed to control the functioning of one or more aspects of subsystems of an imaging system, and claimed subject matter is not limited in this respect.

The printer controller 201 may comprise a microprocessor or microcontroller that is capable of executing machine-readable instructions from a storage medium for performing the aforementioned functions of defining modes of operations. As such, the printer controller 201 may execute machine-readable instructions stored as updateable firmware in a non-volatile memory device (not shown) such as a flash memory device. Alternatively, the printer controller 201 may comprise one or more application specific integrated circuits (ASICs), field programmable gate array (FPGA) devices, application specific programmable devices, and/or any other combination of devices capable of providing logic for performing the aforementioned functions. However, these are merely examples of how logic may be implemented in a printer controller and claimed subject matter is not limited in these respects.

According to an embodiment, in managing the power supplied to the subsystems of the imaging system 100, the printer controller 201 may define operating modes and/or configurations for the imaging system 100 defined by, for example, a speed of the printer 200 (e.g., as affected or characterized by process speed and inter-page gap), power supplied to the fuser, lengthening warm-up time (e.g., delaying the first page out time), changing a fuser profile (e.g., decreasing the fuser temperature to enable maintaining fuser temperature using less power), delaying stapling and/or scanning (e.g., delaying and/or lengthening initialization by running concurrent tasks, such as bulb warm up and motor checking, serially). However, these are merely examples of how a printer controller may control an amount of power being drawn from subsystems of an imaging system and claimed subject matter is not limited in these respects.

Regarding techniques to maintaining fuser temperature using less power, in a particular embodiment, power to fuser 206 may be limited after printing commences. Here, the full power may be applied to the fuser 206 to quickly heat up the thermal mass of fuser 206 while using a lower average power to maintain sufficient heat for proper image fusing. During continuous printing, for example, an average power may gradually increase on long print jobs to account for thermal depletion of fuser 206. In another example, printer controller 201 may result in the printing system pausing after certain number of pages to enable the fuser 206 to recover (e.g., regain its temperature sufficient for proper fusing). Alternatively, printer controller 201 may modify the inter-page gap during large print jobs to enable the printing system to maintain a substantially constant process speed while slightly reducing the throughput. In another embodiment, the printer controller 201 may enable a higher printer throughput (e.g., 50 pages per minute) for an initial set of pages (e.g. 10 pages) and then reduce to a lower throughput (e.g., 40 pages per minute) thereafter. Here, fuser 260 may stay sufficiently warm for the initial set of pages to enable sufficient fusing of toner to the imaging media (and without significant image degradation). After such time, printer controller 201 may decrease the printer throughput (e.g., by decreasing the process speed and/or increasing the inter-page gap) to enable sufficient powering of fuser 260 (to maintain fuser 260 at a high enough temperature for proper fusing) while operating at or below a set power level. However, these are merely examples of techniques to maintain a temperature of a fuser sufficient for proper image fusing while operating at or below a set level of power, and claimed subject matter is not limited in these respects.

Figure 2B:
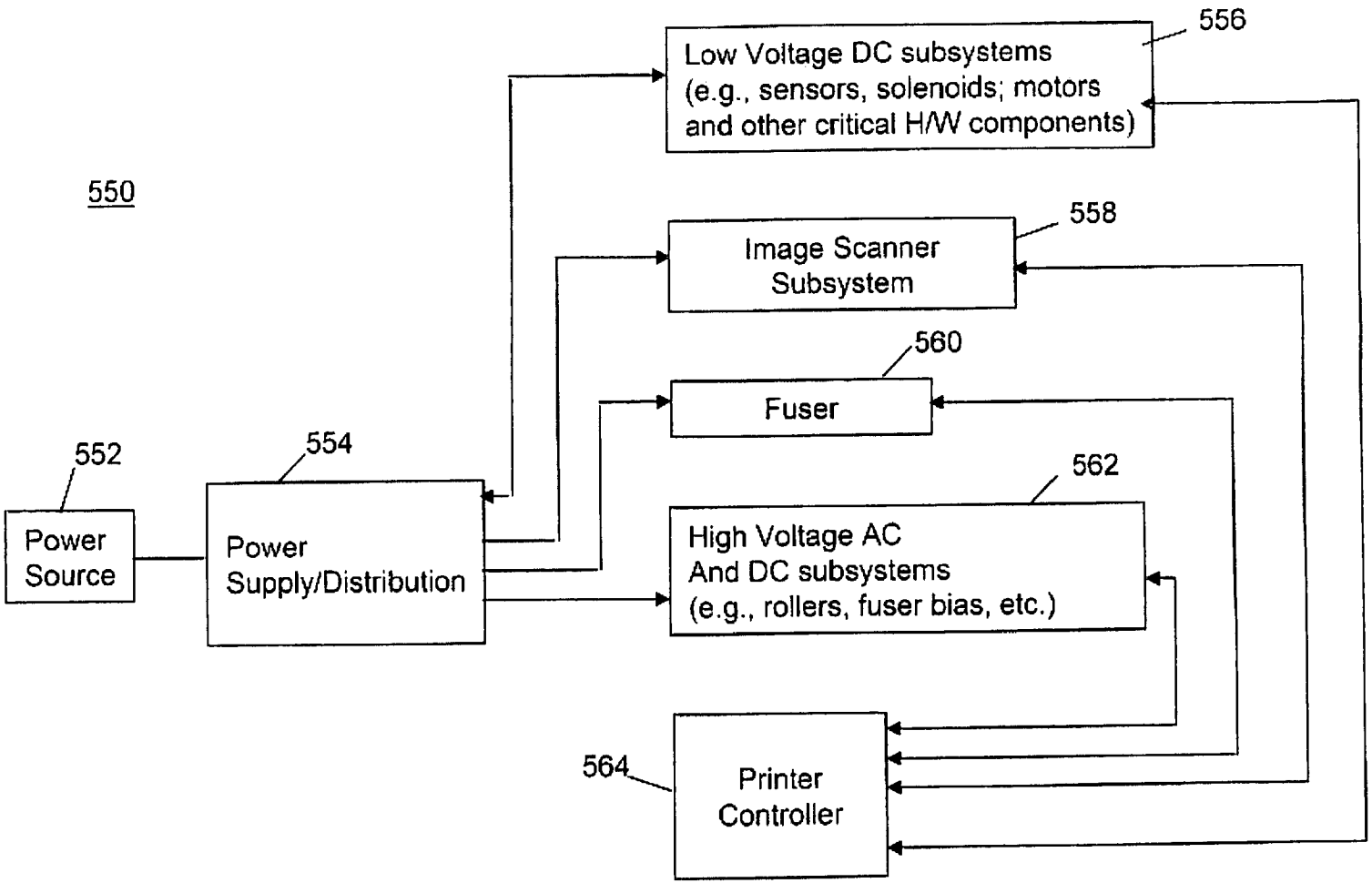
FIG. 2B is a schematic diagram of an embodiment of an imaging system.

FIG. 2B shows how power from a power source 552 may be distributed among subsystems of an imaging system according to an embodiment, such as system 100 shown in FIG. 1. A power supply/distribution subsystem 554 may receive power from a power source 552 (e.g., a utility outlet) and provide a converted power signal to a plurality of subsystems including low voltage DC subsystems 556 (including hardware that provides the controller 564), image scanning subsystem 558, fuser 560 and high AC and DC components subsystems 562. In one embodiment, of the total power converted by the power supply/distribution subsystem 554, the subsystems 556, 558, 560 and 562 may consume approximately 10%, 10%, 70% and 10%, respectively. However, the allocation of total power converted may dynamically change depending, at least in part, on a particular instance in the printing cycle. Also, these are merely examples for illustrative purposes and claimed subject matter is not limited in these respects.

In one embodiment, the controller 564 may monitor power delivered to the fuser 560 and image scanner subsystem 558 (voltage and/or current) so that combined power does not exceed a threshold amount. If the controller 564 detects that image scanning at the image scanner subsystem 558 is commencing, the controller 564 may automatically reduce power to the fuser 560. In one particular embodiment, for the purpose of illustration, the controller 564 may reduce the power to the fuser 560 for a short period (e.g., less than one second) without significantly impacting print throughput and/or process speed. Alternatively, the controller 564 may reduce power to the fuser 560 for a longer period In another embodiment, the printer controller 564 may detect from the low voltage DC subsystems 556 the occurrence of a power loss condition over a period of time (e.g., two occurrences over a twenty-four hour period). Such a loss of power may be detected in a condition where power is removed but the power switch of the imaging system 550 is still in the "on" position. In detecting such an occurrence, the printer controller 564 may deduce that the imaging system 550 had caused the power loss conditions by overloading the building power circuits (e.g., causing fuses or circuit breakers removing power to the imaging system 550). Under such conditions, the printer controller 564 may change the configuration and/or operating mode to use less power by, for example, reducing an amount of power being provided to the fuser 560 to avoid further occurrence of power loss.

In another embodiment, the printer controller 564 may be capable of detecting a fuser under-temperature error. For effective image fusing using laser printing technology it is typically desirable to apply sufficient current and/or power for heating fuser elements and maintaining heated fuser elements at above a threshold temperature. Maintaining the fuser elements at above this threshold temperature may enable sufficient melting of toner and/or vaporization of moisture in the media for properly fusing the image to imaging media.

A "fuser under-temperature condition" or "fuser under-temperature error" as referred to herein, generally relates to an inability to heat and/or maintain heat of fuser elements sufficient to enable fixing of toner to the imaging media. In the presently illustrated embodiment, for example, a sensor (not shown) coupled to the fuser 560 may measure a temperature of one or more fuser elements of the fuser 560 and/or at other locations of the fuser 560. The printer controller 564 may then detect the under-temperature condition from the measured temperature and, in response to this detection, reduce current and/or power provided to subsystems other than the fuser 560 for redistribution to the fuser 560. Alternatively, in a particular embodiment, printer controller 564 may increase the time from the start of a print job to the time when an initial media sheet is first fed through fuser 560, thereby allowing fuser 560 to achieve a temperature sufficient for proper fusing. In yet another alternative, printer controller 564 may compensate for limitations on power provided to fuser 560 by reducing the process speed, and/or increase the size of an inter-page and/or inter-document gap. Following the redistribution of the current and/or power to the fuser 560, the printer controller 564 may perform diagnostics capabilities to re-evaluate the detected under-temperature condition to determine whether the redistribution of power and/or current had corrected the condition and take other measures if the redistribution of power or current had not corrected the condition.

In an alternative to automatically changing the configuration and/or operating mode of the imaging system 550 in response to detection of power loss events, controller 564 may indicate the detection of these events on a display of a user interface (not shown). For example, the display may indicate the particular times and/or frequency of such events. However, this is merely an example of how a printer controller may respond to the detection of loss of power events and claimed subject matter is not limited in these respects. In response, a user and/or technician may manually adjust settings of the imaging system 550 to reduce the power being consumed (e.g., change process speed, inter-page gap, switch to lower power modes for the use of peripherals such as scanners and document feeders, etc.).

Figure 3:
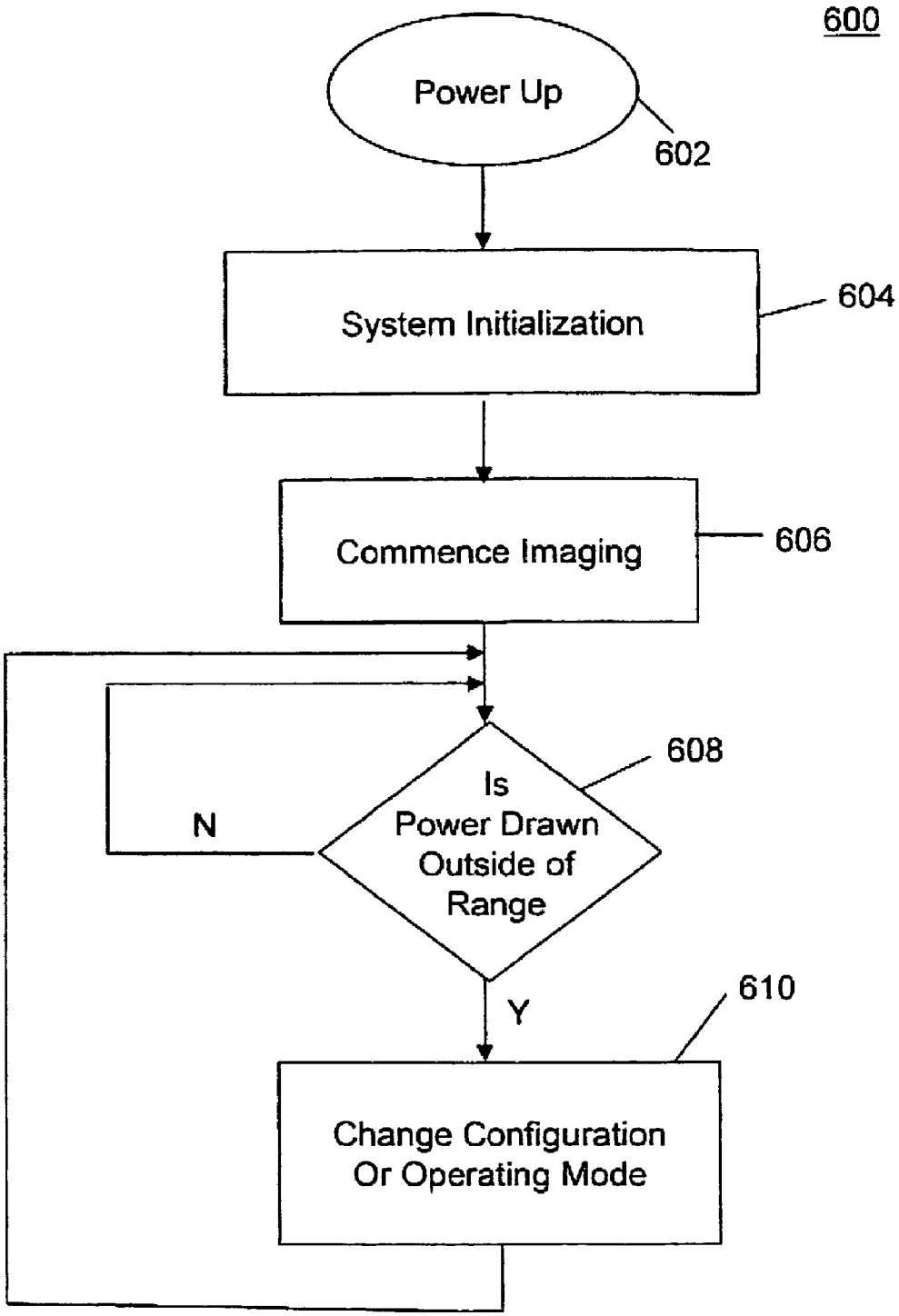
FIG. 3 is a flow diagram illustrating an embodiment of a process to configure an imaging system.

FIG. 3 shows a flow diagram illustrating a process 600 to control a configuration and/or operating mode of an imaging system according to embodiments of the printer controller 201 or printer controller 564, for example. Oval 602 represents a power up event that may occur when a user manually switches on the imaging system 100 or 550. This may result in the power supply 210 or power supply/distribution subsystem 554 receiving power from an outlet and converting the power for use by one or more of the other subsystems of the imaging system. At block 604, the printer controller 201 or 564 may perform system initialization including tasks such as, for example, setting default operating modes, printer speed and/or initiate a warm-up cycle.

Following system initialization at block 604, imaging may commence at block 606 according to a default configuration and/or operating mode or other mode as selected by a user through the UI 202. While the imaging system is operating, the power drawn by the imaging system may be measured at diamond 608. If the measured power level is outside of a predefined range, block 610 may change the configuration and/or operating mode of the imaging system. For example, if the measured power level exceeds and/or approaches a predefined maximum power threshold, which may correspond to a desired upper limit of power drawn, block 610 may change the configuration and/or operating mode of the imaging system so that less power is drawn. In another example, if the measured power level is below a different predefined threshold power level, block 610 may change the configuration and/or operating mode of the imaging system to enable higher level functionality or features that may draw additional power. However, these are merely examples of how a configuration and/or operating mode of an imaging system may be changed in response to a measured level of power being drawn from a power source and claimed subject matter is not limited in these respects.

According to an embodiment, the printer controller 201 may detect a level of power being drawn based, at least in part, upon a signal from the sense circuit 216. For example, the sense circuit 216 may detect a magnitude and/or amplitude of AC current being drawn from a power outlet. In one particular embodiment, for example, the sense circuit 216 may comprise a resistive sensing devices, hall effect sensing device and/or current transformer sensing device for measuring current being drawn. However, these are merely examples of devices that may be employed as sense circuit to determine a level of power being drawn, and claimed subject matter is not limited in these respects.

Figure 4A:
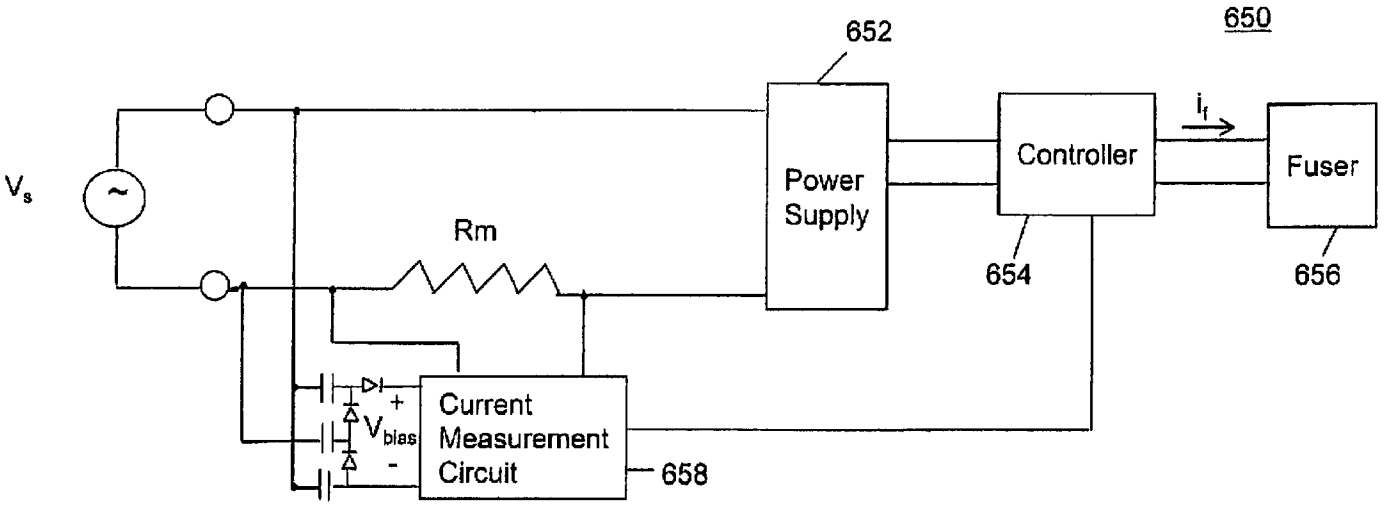
FIG. 4A is a schematic diagram of subsystems of an embodiment of an imaging system including an embodiment of a current measurement circuit.
Figure 4B:
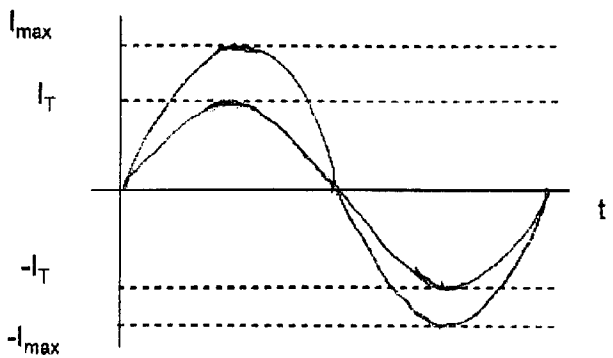
FIG. 4B is a plot of a signal from an embodiment of a power source that may be measured by an embodiment of a current measurement circuit.

In one example embodiment shown in FIGS. 4A and 4B, a power source $V_s$ may provide an AC input signal at a set voltage amplitude (e.g., 110 volts) to a power supply 652. The power supply may then convert the input power signal to a DC signal for control and distribution at a controller 654. The controller 654 may then distribute the converted power signal to a fuser 656 and other subsystems (not shown). A current measurement circuit 658 may measure a voltage across a resistance $R_m$ for measuring the amplitude of the current of the AC input signal. The current measurement circuit 658 may then provide a signal to the controller 654 representative of the measured amplitude of the input current.

From this input, the controller 654 may determine whether the power drawn from the power source $V_s$ is within a predetermined range at diamond 608. FIG. 4B provides a plot of the measured current as a function of time. A threshold current amplitude may be set at $I_T$ and the current level $I_{max}$ may represent the current amplitude that would result if the controller 654 did not control current to subsystems of the imaging system. However, these are merely examples of how the power drawn from an imaging system may be measured and claimed subject matter is not limited in this respect.

Returning to the embodiments of FIGS. 1 through 3, according to a particular embodiment, the printer controller 201 or 564 may change configuration and/or operating mode of the imaging system at block 610 using any one of several techniques of controlling individual subsystems of the imaging system. For example, the controller 201 or 564 may reduce an amount of current being provided to the fuser 206 or 560. The imaging system may consume peak current during startup or while the fuser 206 or 560 is building up residual heat. By limiting power to the fuser 206 or 560 during this initial period, the printing of an initial page of a print job may be delayed for a short period (e.g., a fraction of a second or a few seconds) while the fuser 206 or 560 is heating up with reduced current.

Figure 5:
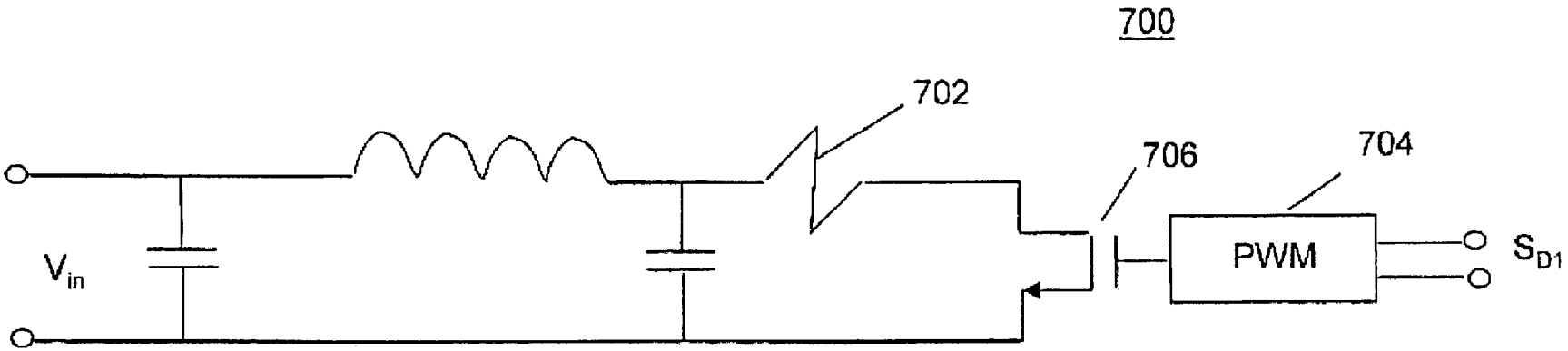
FIG. 5 is a schematic diagram of an embodiment of a circuit for transmitting power to an embodiment of a fuser.

Alternatively, the printer controller 201 or 564 may control current to the fuser 206 or 560 as illustrated in a schematic diagram of a fuser control circuit 700 shown in FIG. 5. The fuser control circuit 700 may receive an input current signal from a power supply (not shown) at an input voltage $V_{in}$. A pulse width modulation circuit 704 may selectively couple an input current to fuser element 702 in pulses through a switch transistor 706 in response to a signal $S_{DC}$ received from a printer controller (e.g., the printer controller 201 or 564. The signal $S_{DC}$ may represent a duty cycle of the pulse current signal applied to the fuser element 702. Accordingly, during peak load conditions, the printer controller 201 or 564 may (e.g., at block 610) decrease the duty cycle of the input current signal to reduce the current being drawn by fuser 260 or 560 from the power source. Here, the printer controller 201 or 564 may increase inter-page gaps to enable more time for the fuser to recover (thereby reducing the average power load of the fuser). In a particular embodiment, for example, printer controller 201 or 564 may increase and/or decrease inter-page gaps to maintain fuser temperature (e.g., while limiting average power to the fuser).

While there has been illustrated and described what are presently considered to be example embodiments, it will be understood by those skilled in the art that various other modifications may be made, and equivalents may be substituted, without departing from the true scope of claimed subject matter. Additionally, many modifications may be made to adapt a particular situation to the teachings of claimed subject matter without departing from the concepts of the present disclosure. Therefore, it is intended that claimed subject matter not be limited to the particular embodiments disclosed, but that claimed subject matter comprises all embodiments falling within the scope of the appended claims.

What is claimed is:

1. An apparatus comprising:

a power sensing circuit to detect a level of power being drawn from a power source by one or more subsystems included in an imaging system; and a controller to configure said apparatus to change an amount of power being drawn from said power source by a fuser in response to said detected level of power to limit the average power to the fuser.

2. The apparatus of claim 1, wherein said power sensing circuit comprises a circuit to detect an amount of current being drawn from said power source to power one or more subsystems of said apparatus, and wherein said controller is capable of configuring said apparatus to change an amount of current being drawn from said power source in response to said detected amount of current.

3. The apparatus of claim 1, wherein said controller is capable of configuring said apparatus to change the amount of power being drawn from said power source in response to said detected level of power exceeding and/or falling below a threshold power level.

4. The apparatus of claim 3, wherein said apparatus further comprises an interface to determine said threshold power level based, at least in part, on user input.

5. The apparatus of claim 3, wherein said controller is capable of configuring said apparatus to decrease the amount of power being drawn from said power source in response to said detected power level exceeding a first threshold power level and capable of configuring said apparatus to increase the amount of power being drawn from said power source in response to said detected power level falling below a second threshold power level.

6. The apparatus of claim 1, wherein said controller is capable of changing a process speed and/or inter-page gap of said imaging system in response to said detected level of power.

7. The apparatus of claim 1, wherein said controller is capable of slowing a process of raising a temperature of the fuser in response to said detected level of power.

8. The apparatus of claim 1, wherein said controller is capable of maintaining a throughput of said imaging system up to a predetermined number of sheets of a print job and lowering said throughput for sheets in the print job beyond the predetermined number of sheets.

9. The apparatus of claim 1, wherein said controller is capable of delaying at least one of scanning an image, transferring an image to a first sheet of a print job and/or stapling in response to the detected level of power.

10. The apparatus of claim 1, wherein said controller is capable of pausing print operations during a print job after a predetermined number of sheets of the print job in response to the detected level of power.

11. A method comprising: supplying power from a power source to one or more subsystems comprising a printing system;

monitoring a level of power drawn from said power source; and configuring said printing system to change an amount of power being drawn from said power source by a fuser in response to said level of power to control the average power to the fuser.

12. The method of claim 11, wherein said monitoring a level of power drawn from said power source further comprises detecting an amount of current being drawn from said power source to power one or more subsystems, and wherein said configuring said printing system to change the amount of power being drawn from said power source further comprises configuring said printing system to change an amount of current being drawn from said power source in response to said detected amount of current.

13. The method of claim 11, wherein said configuring said printing system to change the amount of power being drawn from said power source further comprises configuring said printing system to change the amount of power being drawn from said power source in response to said detected level of power exceeding and/or falling below a threshold power level.

14. The method of claim 13, and further comprises determining said threshold power level based, at least in part, on a user input received at an interface.

15. The method of claim 13, wherein said configuring said printing system to change an amount of power being drawn from said power source further comprises:

configuring said printing system to decrease an amount of power being drawn from said power source in response to said detected power level exceeding a first threshold power level; and configuring said printing system to increase an amount of power being drawn from said power source in response to said detected power level falling below a second threshold power level.

16. The method of claim 11, further comprising changing a process speed and/or throughput of said imaging device in response to said detected level of power.

17. The method of claim 11, further comprising slowing a process of raising a temperature of the fuser in response to said detected level of power.

18. An apparatus comprising:

means for supplying power from a power source to one or more printer subsystems of a printing system, said one or more subsystems comprising at least an imaging device to transfer an image to media;

means for monitoring a level of power drawn from said power source; and means for configuring said printing system to change an amount of power being drawn from said power source by a fuser in response to said detected level of power to control the average power to the fuser.

19. The apparatus of claim 18, wherein said means for monitoring a level of power drawn from said power source further comprises means for detecting an amount of current being drawn from said power source to power one or more subsystems of said printing system, and wherein said means for configuring said printing system to change an amount of power being drawn from said power source further comprises means for configuring said printing system to change an amount of current being drawn from said power source in response to said detected amount of current.

20. The apparatus of claim 18, wherein said means for configuring said printing system to change an amount of power being drawn from said power source further comprises means for configuring said printing system to change an amount of power being drawn from said power source in response to said detected level of power exceeding and/or falling below a threshold power level.

21. The apparatus of claim 20, further comprising means for determining said threshold power level based, at least in part, on a user input received at an interface.

22. The apparatus of claim 20, wherein said means for configuring said printing system to change an amount of power being drawn from said power source further comprises:

means for configuring said printing system to decrease an amount of power being drawn from said power source in response to said detected power level exceeding a first threshold power level; and means for configuring said printing system to increase an amount of power being drawn from said power source in response to said detected power level falling below a second threshold power level.

23. The apparatus of claim 18, further comprising means for changing a process speed and/or inter-page gap of said imaging device in response to said detected level of power.

24. The apparatus of claim 18, said apparatus further comprising means for slowing a process of raising a temperature of the fuser in response to said detected level of power.

25. An apparatus comprising:

a plurality of subsystems including an imaging device and a fuser to fix an image to imaging media, at least in part, on image data;

a power supply to provide a converted power signal to one or more of said subsystems in response to a power signal from a power source;

a power sensing circuit to measure a level of power being drawn from said power source; and a controller to increase and/or decrease a level of power provided to at least one said fuser based, at least in part, on said measured level of power drawn from said power source to limit the average power to the fuser.

26. The apparatus of claim 25, wherein said power sensing circuit comprises a circuit to detect an amount of current being drawn from said power source to power said one or more subsystems, and wherein said controller is capable of configuring said apparatus to change an amount of current being drawn from said power source in response to said detected amount of current.

27. The apparatus of claim 25, wherein said controller is capable of configuring said apparatus to change an amount of power being drawn from said power source in response to said detected level of power exceeding and/or falling below a threshold power level.

28. The apparatus of claim 27, wherein said apparatus further comprises an interface to determine said threshold power level based, at least in part, on a user input.

29. The apparatus of claim 27, wherein said controller is capable of configuring said apparatus to decrease an amount of power being drawn from said power source in response to said detected power level exceeding a first threshold power level and capable of configuring said apparatus to increase an amount of power being drawn from said power source in response to said detected power level falling below a second threshold power level.

30. The apparatus of claim 25, wherein said controller is capable of changing a process speed and/or throughput of said imaging device in response to said detected level of power.

31. The apparatus of claim 25, wherein said controller is capable of slowing a process of raising a temperature of the fuser in response to said measured level of power.

32. The apparatus of claim 25, wherein said controller is capable of pausing print operations during a print job after a predetermined number of sheets of the print job in response to the measured level of power.

33. An article comprising:

a storage medium comprising machine-readable instructions stored thereon to:

monitor a level of power drawn from a power source for powering one or more subsystems of a printing system, said one or more subsystems comprising an imaging device to transfer an image to media; and configure said printing system to change an amount of power being drawn from said power source by a fuser in response to said level of power to limit the average power to the fuser.

34. The article of claim 33, wherein said storage medium further comprises machine-readable instructions stored thereon to:

detect an amount of current being drawn from said power source to power one or more subsystems of said printing system; and configure said printing system to change an amount of current being drawn from said power source in response to said detected amount of current.

35. The article of claim 33, wherein storage medium further comprises machine-readable instructions stored thereon to configure said printing system to change an amount of power being drawn from said power source in response to said detected level of power exceeding and/or falling below a threshold power level.

36. The article of claim 35, wherein said storage medium further comprises machine-readable instructions stored thereon to determine said threshold power level based, at least in part, on a user input received at an interface.

37. The article of claim 33, wherein said storage medium further comprises machine-readable instructions stored thereon to:

configure said printing system to decrease an amount of power being drawn from said power source in response to said detected power level exceeding a first threshold power level; and configure said printing system to increase an amount of power being drawn from said power source in response to said detected power level falling below a second threshold power level.

38. The article of claim 33, wherein said storage medium further comprises machine-readable instructions stored thereon to change a process speed and/or throughput of said imaging device in response to said level of power.

39. The article of claim 33, wherein said storage medium further comprises machine-readable instructions stored thereon to slow a process of raising a temperature of the fuser in response to said level of power.

40. A system comprising:

a plurality of subsystems comprising at least:

a media input unit to sequentially dispense sheets of imaging media;

an imaging device to transfer images to imaging media dispensed from said media input unit based, at least in part, on image data; and a media output unit to receive said imaging media having images transferred thereon;

a power supply to provide a converted power signal to one or more of said subsystems of in response to a power signal from a power source;

a power sensing circuit to measure a level of power being drawn from said power source; and a controller to increase and/or decrease a level of power to at least one of said subsystems based, at least in part, on said measured level of power drawn from said power source to limit the average power to the fuser.

41. The system of claim 40, wherein said media output unit further comprises a stapler.

42. The system of claim 40, wherein said subsystems further comprise a scanner coupled to said imaging device for providing said image data.

43. The system of claim 42, wherein said subsystems further comprise an automatic document feeder to sequentially feed images to said scanner.

44. The system of claim 40, wherein the media output unit further comprises a duplexer, flipper and/or sorter.

45. The system of claim 40, wherein the media input unit further comprises one or more media trays.

46. The system of claim 40, wherein the plurality of subsystems further comprise a formatter.

47. The system of claim 40, and further comprising a bus to transmit at least a portion of said converted power signal to at least one of said media input unit and/or said media output unit.

48. A method comprising:

detecting a fuser under-temperature condition of an imaging device, said imaging device being among a plurality of subsystems of a printing system; and reducing power provided to at least one of said subsystems in response to detecting said fuser under-temperature condition in a manner which limits the average power to the fuser.

49. The method of claim 48, further comprising evaluating a state of said under-temperature condition following said reduction of power provided to said at least one of said subsystems.

50. The method of claim 48, further comprising:

receiving power from a power source;

distributing said received power among at least some of said subsystems; and redistributing power among said subsystems in response to detecting said under-temperature condition.

51. The method of claim 48, said method further comprising changing a process speed of said imaging device in response to detecting said under-temperature condition.

52. An apparatus:

means for detecting a fuser under-temperature condition of an imaging device, said imaging device being among a plurality of subsystems of a printing system; and means for reducing power provided to at least one of said subsystems in response to detecting said fuser under-temperature condition in a manner which limits the average power to the fuser.

53. The apparatus of claim 52, said apparatus further comprising means for evaluating a state of said under-temperature condition following said reduction of power provided to said at least one of said subsystems.

54. The apparatus of claim 52, said apparatus further comprising:

means for receiving power from a power source;

means for distributing said received power among at least some of said subsystems; and means for redistributing power among said subsystems in response to detecting said under-temperature condition.

55. The apparatus of claim 52, said apparatus further comprising means for changing a process speed and/or throughput of said imaging device in response to detecting said under-temperature condition.

56. An article comprising:

a storage medium comprising machine-readable instructions stored thereon to:

detect a fuser under-temperature condition of an imaging device, said imaging device being among a plurality of subsystems of a printing system; and reduce power provided to at least one of said subsystems in response to detecting said fuser under-temperature condition in a manner which limits the average power to the fuser.

57. The article of claim 56, wherein said storage medium further comprises machine-readable instructions stored thereon to evaluate a state of said under-temperature condition following said reduction of power provided to said at least one of said subsystems.

58. The article of claim 56, wherein said storage medium further comprises machine-readable instructions stored thereon to:

distribute power received from a power source among at least some of said subsystems; and redistribute power among said subsystems in response to detecting said under-temperature condition.

59. The article of claim 56, wherein storage medium further comprises machine-readable instructions stored thereon to change a process speed and/or throughput of said imaging device in response to detecting said under-temperature condition.

60. An apparatus comprising:

a circuit to detect a fuser under-temperature condition of an imaging device; and a controller to configure an imaging system to change an amount of power being drawn from a power source in response to said detected fuser under-temperature condition in a manner which limits the average power to the fuser.

61. The apparatus of claim 60, wherein said controller is capable of evaluating a state of said under-temperature condition following said change in power being drawn from said power source.

62. The apparatus of claim 60, wherein said controller is capable of distributing power received from a power source among a plurality of subsystems, and redistributing power among said subsystems in response to detecting said under-temperature condition.

63. The apparatus of claim 60, wherein said controller is capable of initiating a change of a process speed and/or throughput of said imaging device in response to detecting said under-temperature condition.

64. A method comprising:

receiving power at a printing system from a power source;

distributing said received power among one or more subsystems of said printing system;

detecting one or more lapses in said receipt of power at said printing system over a predetermined period; and reducing an amount of power being provided to said one or more of said subsystems in response to detecting said one or more lapses in a manner which limits the average power to the fuser.

65. The method of claim 64, said method further comprising changing a process speed and/or throughput of said imaging device in response to detecting said one or more lapses.

66. The method of claim 64, said method further comprising reducing an amount of power provided to a fuser in response to detecting said one or more lapses.

67. The method of claim 64, said method further comprising reducing an amount of current being drawn from said power source in response to detecting said one or more lapses.

68. The method of claim 67, said method further comprising reducing an amount of current being provided to one or more of said subsystems.

69. An apparatus comprising:

means for receiving power at a printing system from a power source;

means for distributing said received power among one or more subsystems of said printing system;

means for detecting one or more lapses in said receipt of power at said printing system over a predetermined period; and means for reducing an amount of power being provided to said one or more of said subsystems in response to detecting said one or more lapses in a manner which limits the average power to the fuser.

70. The apparatus of claim 69, said apparatus further comprising means for changing a process speed and/or throughput of said imaging device in response to detecting said one or more lapses.

71. The apparatus of claim 69, further comprising means for reducing an amount of power provided to a fuser in response to detecting said one or more lapses.

72. The apparatus of claim 69, further comprising means for reducing an amount of current being drawn from said power source in response to detecting said one or more lapses.

73. The apparatus of claim 72, further comprising means for reducing an amount of current being provided to one or more of said subsystems.

74. An apparatus comprising:

a circuit to detect one or more lapses in receipt of power at a printing system; and a controller to reduce an amount of power being provided to one or more of subsystems of said printing system in response to detecting said one or more lapses in a manner which limits the average power to the fuser.

75. The apparatus of claim 74, wherein said controller is capable of changing a process speed of said printing system in response to detecting said one or more lapses.

76. The apparatus of claim 74, wherein said controller is capable of reducing an amount of power provided to a fuser in response to detecting said one or more lapses.

77. The apparatus of claim 74, wherein said controller is capable of reducing an amount of current being drawn from said power source in response to detecting said one or more lapses.

78. The apparatus of claim 77, wherein said controller is capable of reducing an amount of current being provided to one or more of said subsystems.

* * * * *